United States Patent [19]

Ebert

[11] 3,980,274

[45] Sept. 14, 1976

[54] CARPET STRETCHER HOLDER

[76] Inventor: Jack Edward Ebert, 103 W. Stratford Place, Mount Prospect, Ill. 60056

[22] Filed: Oct. 16, 1975

[21] Appl. No.: 622,944

[52] U.S. Cl. ..... 254/57
[51] Int. Cl.[2] ..... A47G 27/04
[58] Field of Search ..... 254/57–63

[56] References Cited

UNITED STATES PATENTS

| | | | |
|---|---|---|---|
| 3,001,762 | 9/1961 | Skolnick | 254/62 |
| 3,178,155 | 4/1965 | Bird | 254/62 |
| 3,311,347 | 3/1967 | Thompson | 254/57 |
| 3,752,440 | 8/1973 | Ream | 254/62 |

*Primary Examiner*—Al Lawrence Smith
*Assistant Examiner*—Robert C. Watson
*Attorney, Agent, or Firm*—Darbo, Robertson & Vandenburgh

[57] ABSTRACT

A supplemental frame is used with a conventional carpet stretcher to transmit the rearward force from the carpet stretching operation to the tacking strip forwardly of the carpet stretcher as a pulling force. The supplemental frame has a blade which fits between the carpet engaging strip and the wall and a pressure member which is rearwardly of the carpet stretcher for the tailpiece of the carpet stretcher to abut.

8 Claims, 4 Drawing Figures

Fig. 1.
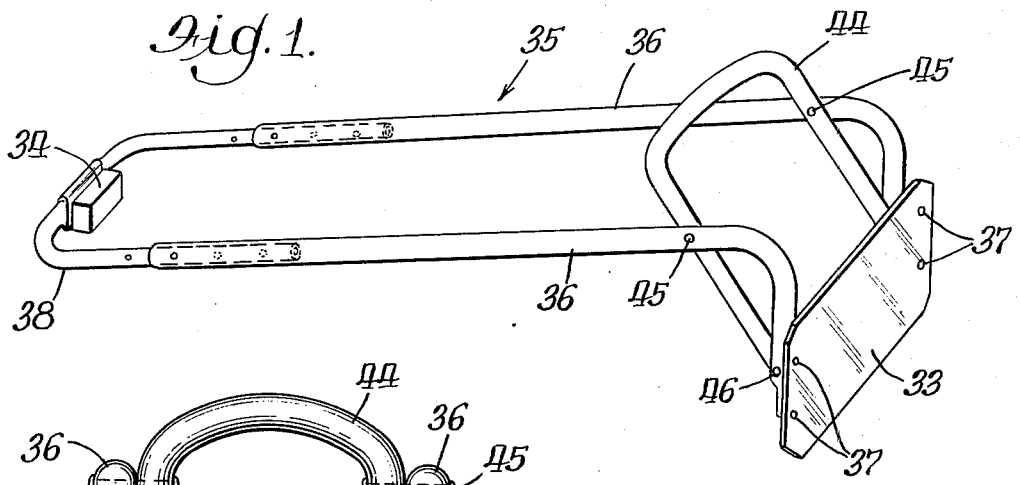
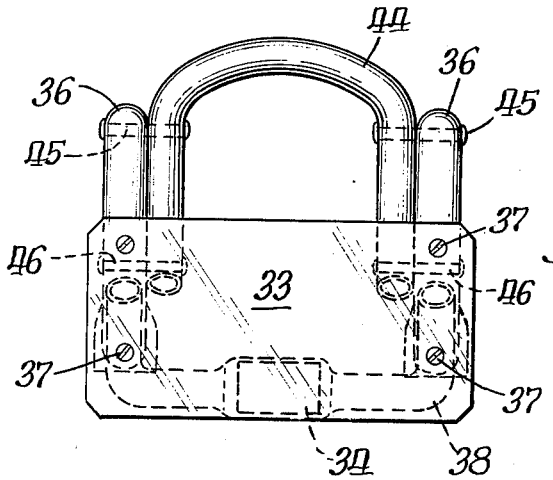
Fig. 2.
Fig. 3.
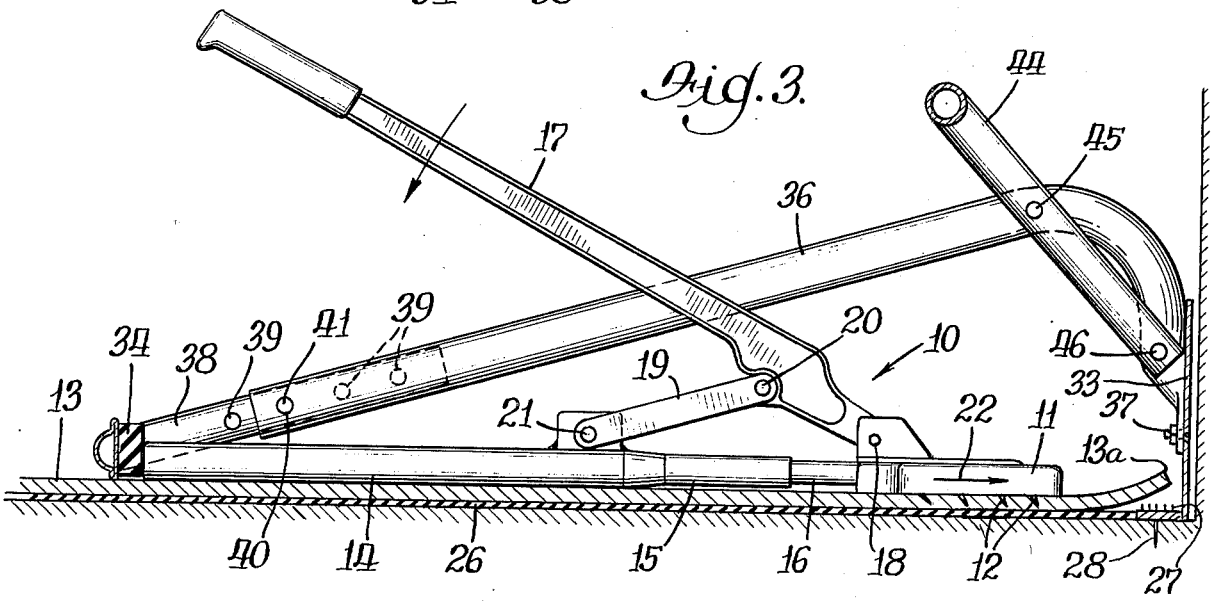
Fig. 4.
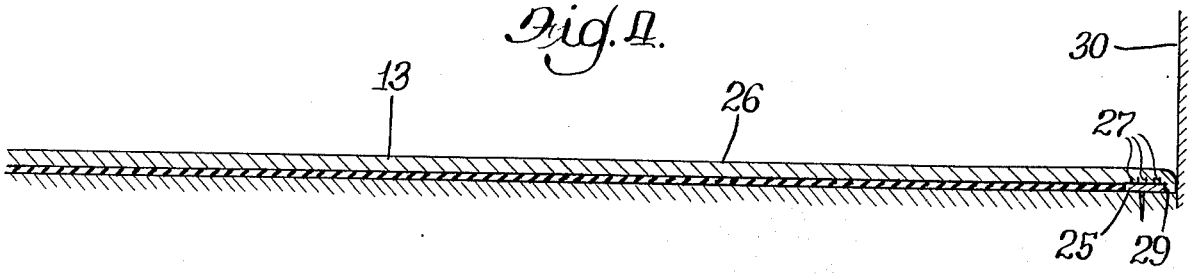

CARPET STRETCHER HOLDER

BACKGROUND AND SUMMARY OF THE INVENTION

One form of carpet stretcher commonly used in the laying of carpet comprises a head with downwardly extending teeth to engage the carpet, a tailpiece and extensions through which pressure is applied to the opposite wall of the room to resist the stretching force, and manually operable power means interconnecting the head and the tailpiece to force the head away from the tailpiece thus developing a force to pull the carpet. Since the distance between the location at which the pulling force is to be applied to the carpet and the opposite wall will always be varying, sectional extension poles are employed to transmit the pulling force from the tailpiece to the opposite wall. These are large and cumbersome. They must be carried to the job and subsequently removed. Even on a single job, the usual situation requires that the length of the poles be changed from time to time in order to accommodate the various pulling requirements. Furthermore, on some jobs there may be obstructions, e.g., a piece of furniture which it is not practical to move, making it difficult or impossible to position the poles so as to apply the pressure force from the tailpiece to the opposite wall. A "kicker" is often employed by a carpet layer, but it is not an adequate substitute for a power stretcher.

The present invention is an attachment for a conventional power stretcher to transmit the stretching force as a pulling force applied to the floor ahead of the stretcher, in contrast to the present practice of applying it as a pressure force to the wall at the rear of the stretcher. This invention has the advantages that: it is relatively low in cost, even as compared to the extension poles commonly employed; it is small and lightweight to move about and much less cumbersome than the extension poles; it permits the power stretcher to be used at a location at which an extension pole to reach the opposite wall could not be employed.

In the present invention, a blade is hooked against the side of the tacking strip opposite to the area in which the carpeting is being laid, a pressure member is placed at the rear of the tailpiece of the carpet stretcher and a frame transmits the carpet stretching force from the pressure member to the blade and thus to the carpet strip immovably secured to the floor. I am aware that an apparatus known as a power restretcher has been available to carpet layers and that this restretcher employs a blade which is hooked onto the tacking strip in a fashion similar to the blade of my attachment. However, these re-stretchers are a relatively complicated piece of equipment, certainly as compared to the attachment of my invention. This means that the carpet layer has a substantial additional investment in a re-stretcher, along with the problem of getting it on the job and removing it when the job is done. My invention is not a carpet stretcher in and of itself, but rather is an attachment for the stretcher that the carpet layer already will have, the attachment increasing the versatility of that existing carpet stretcher at a modest cost.

Further objects and advantages become apparent from the following description and the drawings.

DESCRIPTION OF THE DRAWINGS

FIG. 1 is an isometric view of an embodiment of my invention;

FIG. 2 is an end view of the embodiment of FIG. 1;

FIG. 3 is a sectional view of the embodiment of FIG. 1 being used in conjunction with an exemplary carpet stretcher in the stretching of carpet; and FIG. 4 is a view similar to FIG. 3, but showing the carpet after the laying job is finished. FIG. 4 illustrates a conventional, and prior art, situation.

DESCRIPTION OF SPECIFIC EMBODIMENT

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

Included in FIG. 3 is an illustration of a conventional, power carpet stretcher, generally 10. It comprises a head 11 having downwardly extending teeth 12 to engage the carpet 13. There is a tailpiece 14 which includes a forwardly extending tube 15. A rod 16 forming a part of head 11 is slideably received in tube 15. A manually operable power means interconnects the head and the tailpiece to move the head away from the tailpiece and thus apply a pulling force to the carpet through the teeth 12. In the illustrated power stretcher this power means is a toggle joint of which handle 17 is a part. Thus, the handle is pivotally secured to head 11 by a pin 18. A pair of links 19 are pivotally connected to handle 17 by pin 20 and pivotally connected to tailpiece 14 by pin 21. Thus, as the handle 17 is moved downwardly from a raised position, the toggle joint applies a force to the head and tailpiece causing the two to separate, i.e., head 11 to move in the direction indicated by arrow 22 away from tailpiece 14. In the conventional practice various lengths of extension tubing (not shown) extend from tailpiece 14 to a pressure pad bearing against the opposite wall. Thus, the tailpiece 14 is held immovable by the opposite wall as the handle 17 is pushed down, with the result that the head 11 moves in the direction of arrow 22 to apply the pulling force to the carpet.

At one time the periphery of carpeting was tacked down around its edges to hold the carpeting in place after the installation was completed. The general practice today is to use a so-called "tackless" installation; that is, a tacking strip 25 is used at the borders of the area in which the carpeting is to be laid. This tacking strip is of approximately the same thickness as the carpet padding 26 and has upwardly extending prongs or projections 27 to engage the carpeting. The tacking strip is secured to the floor as by means of nails 28. Along the walls a small space 29 is provided between the tacking strip 25 and the wall 30. After the carpeting has been stretched the borders of the carpeting are pushed down into space 29, as illustrated in FIG. 4. This serves two functions: one being to conceal the raw edge of the carpeting; and the second being to securely engage the carpeting with projections 27 of the tacking strip.

FIGS. 1 and 2 illustrate the attachment I have devised to hold the tailpiece of the carpet stretcher in place while the carpet is being stretched, as an alternative to the extension poles now being employed. This does not necessarily imply that a carpet layer will not use the extension poles, but my invention provides him with an alternative so that he can adapt his carpet stretching techniques to the conditions of a particular job.

In the illustrated embodiment there is an engaging means, in the form of a blade 33, for engaging the tacking strip 25; a pressure member, in the form of elastomeric pad 34, against which the pressure of the tailpiece 14 may be applied, and a frame, generally 35, interconnecting the pressure pad 34 and the blade 33. As best seen in FIG. 2, the pad 34 is centered on a line normal to blade 33 at its center. The frame includes a pair of L shaped members 36. The base or small parts of these L members are secured to blade 33 at respective ends as by means of bolts 37. A U shaped connecting member 38 has distal portions which telescope into respective large parts of the L members 36. The U member has a plurality of openings 39 while each of the L members 36 has but a single pair of openings 40. With one set of openings 39 aligned with the openings 40, a pin 41 is inserted therethrough to lock the two members against any telescopic movement. The presence of different sets of openings 39 permits the distance from pad 34 to blade 33 to be changed to accommodate various sizes of carpet stretchers. The pad 34 is centered on the base of the U member 38.

Adjacent blade 33 is a U member 44. It has two distal portions which span and are connected to respective L members 36 by pins 45 and 46. The base of member 44 serves as a handle to facilitate the manipulation of the attachment. The distal portions of the member act as angle braces for the L members 36.

The use of my attachment in conjunction with the conventional carpet stretcher 10 is best seen by the illustration of FIG. 3. As in a conventional carpet laying operation, the tacking strip 25 will have been secured to the floor adjacent the walls. The padding 26 will have been laid and fitted in the area defined by the tacking strips. The carpeting 13 will have been spread across the area that it is to occupy, ready for the stretching operation. Thereupon the blade 33 of my attachment is positioned in the space 29 between the tacking strip and the wall. When so positioned the blade can engage that side of the tacking strip that is adjacent the wall to thereby prevent movement of the attachment away from the wall 30. The carpet stretcher 10 is positioned within the frame 35 in a manner such that the tailpiece 14 bears against pad 34. The handle 17 of the carpet stretcher can be raised through the frame 35, i.e., between members 36. The teeth 12 are engaged with the carpet. The downward movement of handle 17 causes the head 11 to move away from tailpiece 14. As this occurs, the tailpiece applies its carpet pulling force to pad 34. However, the pad is held immovable since that force is transmitted through the frame 35 to the blade 33, and from the blade through the side of the tacking strip 25 to the floor. The carpet stretcher 10, along with my attachment, can easily be moved from place to place as the stretching operation requires.

During the carpet stretching operation, the raw edge 13*a* of the carpet is merely loose on the floor. This is in accordance with the conventional practice. As a matter of fact, the final cut to size of the carpet is often not performed until after the stretching operation is completed. When the stretching operation is completed the raw edge 13*a* is forced down into space 29 in a conventional manner.

I claim:

1. An apparatus for use in the process of laying carpet over an area of floor having a tackless carpeting strip immovably secured at a border of the area and employed in conjunction with a power carpet stretcher comprising a frontwardly extending carpet engaging head, a rearwardly extending tailpiece and power means interconnecting the head and tailpiece for moving the head away from the tailpiece, said apparatus comprising:

a unit separate from said power carpet stretcher and unconnected thereto, said unit including:

engaging means for placing in engagement with the side of the carpet strip opposite to said area whereby a pulling force in a direction from the area toward the carpet strip may be applied to the carpet strip;

a pressure member for positioning in said area and spaced from said engaging means a distance greater than the length of the stretcher from the distal end of the head thereof to the distal end of the tailpiece thereof, whereby the stretcher may be positioned on said area with said tailpiece against the pressure member and said head engaging the carpet adjacent said strip; and frame means interconnecting the engaging means and the pressure member to prevent their separation, whereby as said power means is operated the pressure of the tailpiece against the pressure member is transmitted by the frame means to the engaging means and thus to the strip which holds the apparatus and tailpiece against movement.

2. An apparatus as set forth in claim 1, wherein said engaging means is a blade having a significant length in the direction parallel to said strip and being relatively thin as measured parallel to the direction of said pulling force.

3. An apparatus as set forth in claim 2, wherein said frame means is adjustable whereby the distance between said engaging means and said pressure member may be varied to accommodate various sizes of carpet stretchers.

4. An apparatus as set forth in claim 3, wherein said frame means includes two front members, each front member having two parts arranged substantially in the form of an L, one part being approximately vertical and secured to said blade adjacent a respective end of the blade, the other part extending rearwardly, a rear member substantially in the form of a U with a base and two distal portions, each distal portion being telescopically mounted on a respective other part, said pressure member being an elastomeric pad secured to the base of the U, and a handle member substantially in the form of a U with a base and two distal portions, each of the latter distal portions extending between the two parts of a respective front member and secured thereto, the latter base being upwardly to serve as a handle.

5. In the combination of a carpet stretcher and a device for holding the stretcher against movement when the stretcher applies a pulling force to the carpet, for use in the process of laying carpet over an area of a floor having a tackless carpeting strip immovably secured at a border of that area, said carpet stretcher comprising a frontwardly extending carpet engaging head, a rearwardly extending tailpiece and power means interconnecting the head and tailpiece for moving the head away from the tailpiece, the improvement wherein said device comprises:

a unit separate from said power carpet stretcher and unconnected thereto, said unit including:

engaging means for placing in engagement with the side of the carpet strip opposite to said area, whereby a pulling force in a direction from the area toward the carpet strip may be applied to the carpet strip;

a pressure member for positioning in said area and spaced from said engaging means a distance greater than the length of the stretcher from the distal end of the head thereof to the distal end of the tailpiece thereof, whereby the stretcher may be positioned on said area with said tailpiece against the pressure member and said head engaging the carpet adjacent said strip; and frame means interconnecting the engaging means and the pressure member to prevent their separation, whereby as said power means is operated the pressure of the tailpiece against the pressure member is transmitted by the frame means to the engaging means and thus the strip which holds the apparatus and tailpiece against movement.

6. In the combination as set forth in claim 5, wherein said engaging means is a blade having a significant length in the direction parallel to said strip and being relatively thin as measured parallel to the direction of said pulling force.

7. In the combination as set forth in claim 6, wherein said frame means is adjustable whereby the distance between said engaging means and said pressure member may be varied to accommodate various sizes of carpet stretchers.

8. In the combination as set forth in claim 6, wherein said frame means includes two front members, each front member having two parts arranged substantially in the form of an L, one part being approximately vertical and secured to said blade adjacent a respective end of the blade, the other part extending rearwardly, a rear member substantially in the form of a U with a base and two distal portions, each distal portion being telescopically mounted on a respective other part, said pressure member being an elastomeric pad secured to the base of the U, and a handle member substantially in the form of a U with a base and two distal portions, each of the latter distal portions extending between the two parts of a respective front member and secured thereto, the latter base being upwardly to serve as a handle.

* * * * *